United States Patent [19]

Eck

[11] Patent Number: 4,955,615

[45] Date of Patent: Sep. 11, 1990

[54] HEXAGONAL GAME TILES

[75] Inventor: Brian D. Eck, 10901 N. Florida, Oklahoma City, Okla. 73120

[73] Assignee: Brian Daniel Eck, Oklahoma City, Okla.

[21] Appl. No.: 388,678

[22] Filed: Aug. 2, 1989

[51] Int. Cl.[5] ..... A63F 3/00; A63H 33/08

[52] U.S. Cl. ..... 273/241; 273/290; 446/118; 446/125; 52/82; 52/81; 52/589; 52/591; 52/593

[58] Field of Search ..... 273/241, 290, 275, 283, 273/284, 153 R; 446/117, 118, 125; 52/81, 82, 589–594, 568–570, 608, 609

[56] References Cited

U.S. PATENT DOCUMENTS 3,010,888 11/1961 Battle ..... 52/608
3,891,217 6/1975 Geary et al. ..... 273/282

FOREIGN PATENT DOCUMENTS 2167672 6/1986 United Kingdom ..... 273/157 R

*Primary Examiner*—Benjamin Layno

[57] ABSTRACT

A set of hexagonal playing pieces, of a shape which when played side to side in beehive pattern create a base, for successive interlocking levels of play. Each player attempts to place his tiles in the most strategically advantageous position.

2 Claims, 2 Drawing Sheets

HEXAGONAL GAME TILES

BACKGROUND OF THE INVENTION

Various kinds of games have been designed, which demonstrate the tendencies of human nature, and society in general in fairly abstract form. The present invention uses a set of hexagonal tiles, or game pieces, stacked next to and on top of each other to illustrate the value, and necessity of individual cooperation with existing and established power structures.

In reference to the prior art, the Lipps U.S. Pat. No. #4,025,076, The Flynn U.S. Pat. No. #4,305,585 and the Haswell U.S. Pat. No. #1,558,165 all incorporate the use of a hexagonal playing piece, yet none of them offer the possibility of a game played one layer on top of another. The Morley Patent #4,673,185 also uses hexagonal shaped tiles, and incorporates the use of symbols, which are similar to my preferred embodiment, though not in a stacking form of play.

BRIEF SUMMARY OF THE INVENTION

The invention consists of a set of hexagonal playing pieces, (hereafter referred to as tiles) which when arrayed into a honeycomb pattern form the foundation for successive levels of play. Three, four, five and more levels all interlock with each other, as players position their tiles to exert maximum influence over the whole collection of tiles.

Each player receives a sufficient number of hexagonal tiles in his color, each of which contain suitable markings on the top surface, to denote members of society with varying degrees of influence and ability. Each player turns his tile upside down, so that the tiles are indistinguishable, and shuffles them, as one would a set of dominoes.

The first player draws a tile, turns it over, and places it on the playing surface. The second player does the same, and plays his tile so that it adjoins one of the six sides of the previous tile. The third player has the option of playing his tile so that it adjoins an unexposed side of either of the previously played tiles. Play continues as such in turn until one player achieves a solid base of his own color. The base consists of three adjoining tile; each sharing two common sides wherein a second level tile is able to rest equally atop the three of his color. This is the only way second-level play may begin. This first tile, on the second level shall be referred to as the "kingpin", and to a degree, determines the likely course of future play.

The next player, after the opening of second level play, has the option of playing on the first level, according to the previous rules, or adjoining the "kingpin" for the more influential second level positions. He must however, be resting atop at least one of his own tiles, as he adjoins at least one side of one tile previously played on that level. There can be only one kingpin for each new level of play, and all tiles played after the kingpin must adjoin it either directly or indirectly. For instance, no one may play "floating" pieces which do not join with the main body, of any particular level.

DESCRIPTION OF THE PREFERRED EMBODIMENT

Figure 1:
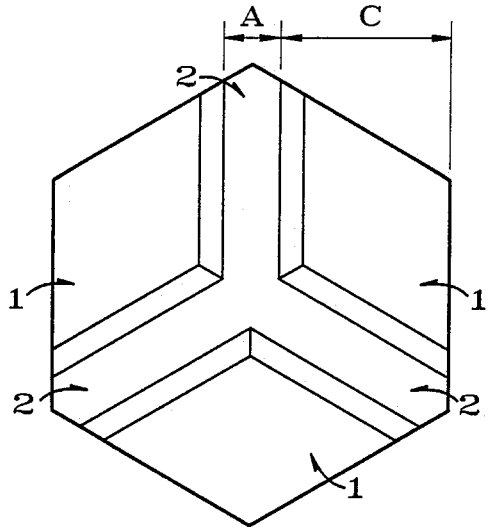
FIG. 1 illustrates a top view of game piece.

Referring now to the drawings:

FIG. 1 illustrates the shape and the face side of one embodiment of my invention.

Figure 2:
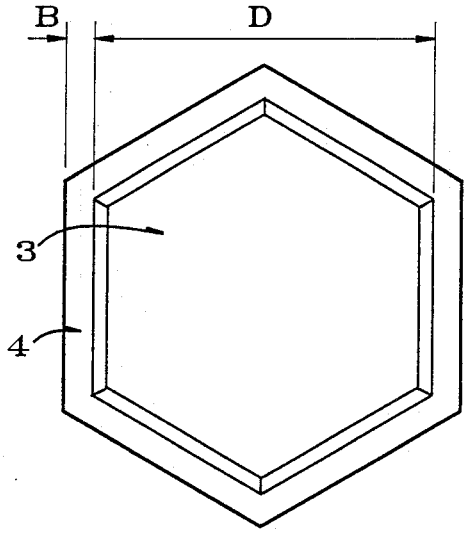
FIG. 2 illustrates a bottom view of a game piece.

FIG. 2 illustrates the shape and the reverse side of one embodiment of my invention. The game consists of a number of substantially hexagonal shaped game pieces with each piece having three substantially rhombic raised surfaces 1 on three of its opposing corners, and three "foot paths" or troughs 2 which begin at the remaining three corners and meet in the center. The reverse side of each piece having a recessed "cup" 3 of substantially hexagonal shape, and a "footprint" 4 running along the perimeter of the piece.

Figure 3:
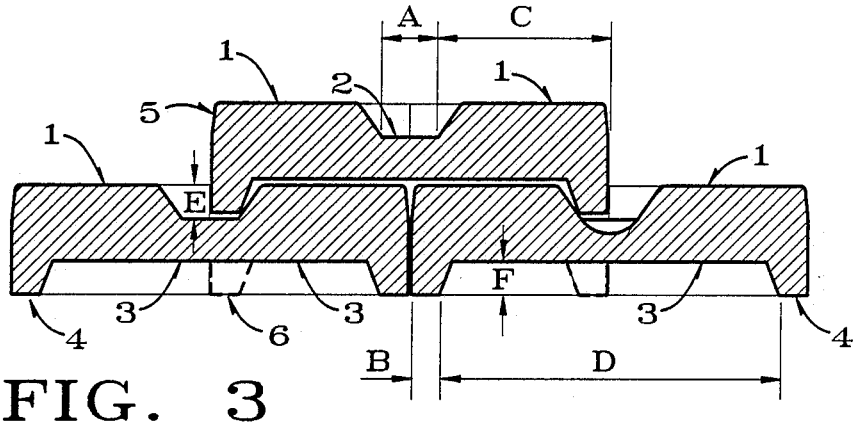
FIG. 3 illustrates a cross sectional view of three stacked game pieces.

FIG. 3 is a cross section through three game pieces illustrating how the indentions and recesses on the face and reverse sides of the pieces assist their stackability. The width of footpath 2 on the face surface, (designated as dimension "A") shall be a minimum of 2x the width of footprint 4 on the reverse surface, (designated as dimension B) plus a small addition for tolerance. Similarly, the width of cup 3 on the reverse surface, (designated as dimension "D") shall be a minimum of 2x the width of the raised rhombic surface 1 on the face side (designated as dimension "C"), plus a small addition for tolerance.

The top game piece in FIG. 3 shown as 5 is actually resting equally atop three adjoining pieces on the lower level, the third of which is shown beyond in dashed form as 6.

Figure 4:
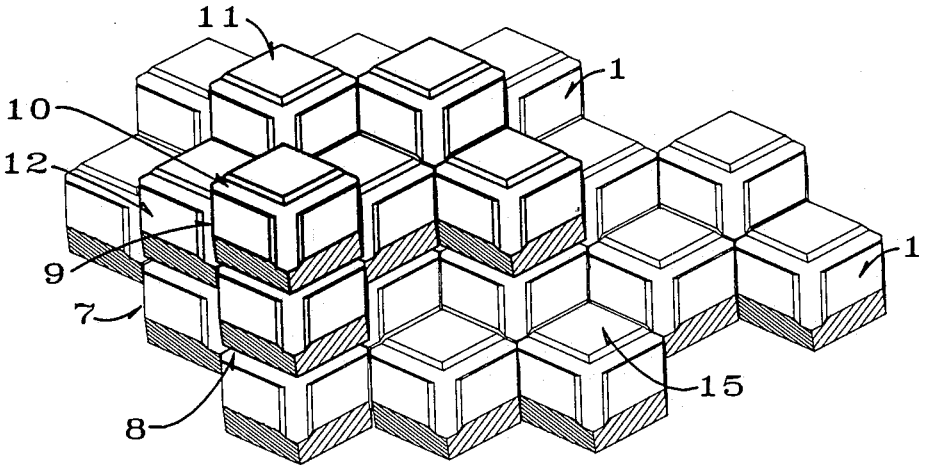
FIG. 4 illustrates a plurality of stacked game pieces forming three levels.

The method of stacking is illustrated more clearly in FIG. 4, which is an overhead view of a succession of three levels of game pieces. Levels one, two, and three identified in succession as 7, 8, and 9. The single third level game piece demonstrates its basic function in resting atop the adjoined rhombic protrusions of the game pieces 11, 12, and 13, of level two. The concealed hexagonal shape (composed of the three rhombic protrusions) beneath game piece 10 is identical to the one designated as 14, also on level two and 15 on level one. These places remain open for future play.

Having described the basic form and function of the tiles it should be noted that a substantial number of games may be devised using game tiles of varying colors, and of relative significance.

By relative significance, it should be understood that the preferred embodiment of the invention merely demonstates an example of a "set of characters", & also alternate "types" of characters of strategy. Using a set of tiles of relative power to each other, (similar to the way one playing cards, for example, higher value cards overpowers all cards of a lesser value, or the way a Jack may be played only upon a 10.) it becomes possible to imagine various games wherein certain characters may stack only upon a limited number of characters, or may simply overpower another character when played on the same level.

Figure 5:
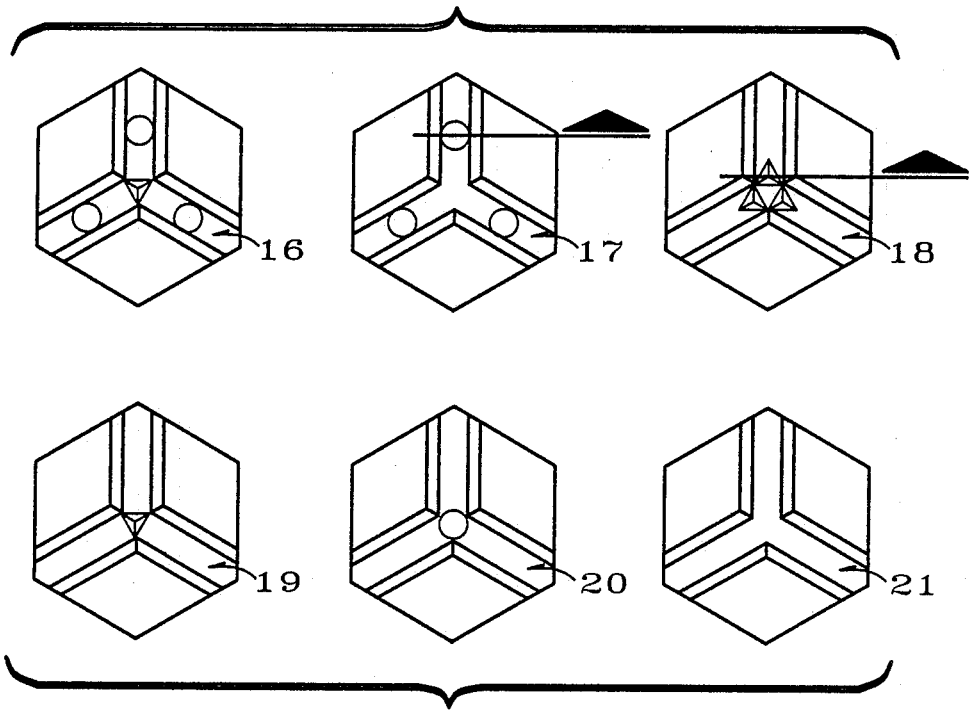
FIG. 5 illustrates game pieces having various symbols engraved thereon.
Figure 6:
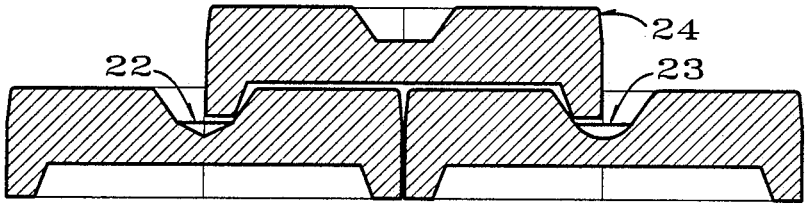
FIG. 6 illustrates a cross sectional view of three stacked game pieces having symbols engraved thereon.

One preferred method of designating relative tile importance being illustrated in FIG. 5. Here the footpaths have been engraved with symbols in tiles 16 thru 20, and tile 21 has been left in its original form. It should be noted that symbols which occur in the foot path must be recessed into the path for proper stacking as demonstrated in FIG. 6. Lines 22 and 23 respectively show the undisturbed foot path beyond the section cut, upon which the footprint of successive tiles 24 must rest.

Figure 7:
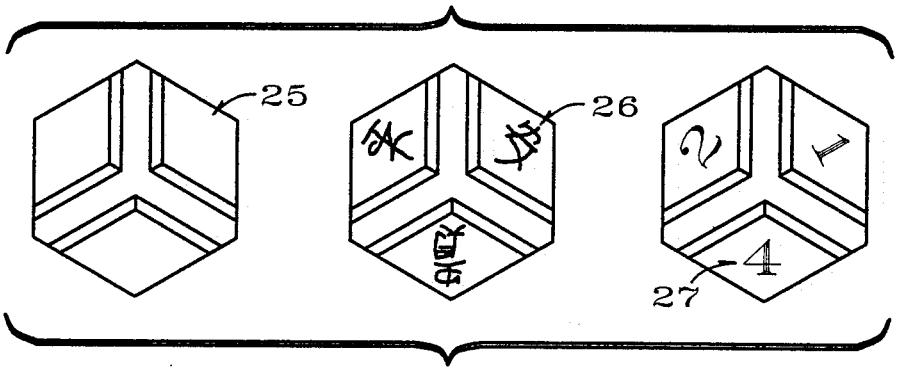
FIG. 7 illustrates game pieces having alternatives types of symbols engraved thereon.

FIG. 7 demonstrates three alternative forms or types of markings which may be placed on the tiles. Tile 25 uses the symbols commonly referred to as the "I Ching" in the Orient, and allows for the reading of a sentence during play or at the completion of the game. Similarly, 26 uses standard Chinese characters as a means of playing this game. These could also be

What I claim is:

1. A game or amusement device consisting of a set of hexagonal playing pieces, which when arrayed side to side into a horizontal honeycomb patterned playing field, form the foundation for successive levels of interlocking play, said individual hexagonal pieces each have male protrusions on one surface, which match the female indentions on the opposite side of the piece, so that each tile interlocks with every other piece, said individual hexagonal pieces each have three male rhombic protrusions projecting up from three opposing corners on one surface, so that when the rhombic shapes of three adjoining pieces are together, they complete a single hexagonal male protrusions matching the hexagonal female indention on the underside of every piece; thus a fourth piece may rest in an interlocking fashion equally atop the three pieces beneath it.

2. A game or amusement device as recited in claim 1, wherein either surface of the playing pieces are marked with characters designating their relative power over, or relationship to other pieces; said characters may be a symbolic numerical, alphabetical, or literary device.

* * * * *